United States Patent [19]

Tanaka

[11] Patent Number: 4,961,028

[45] Date of Patent: Oct. 2, 1990

[54] LIGHTING EQUIPMENT

[75] Inventor: Hiroaki Tanaka, Tokyo, Japan

[73] Assignee: Hayashi Tokei Kogyo Kabushiki Kaisha, Tokyo, Japan

[21] Appl. No.: 269,493

[22] Filed: Nov. 10, 1988

[51] Int. Cl.[5] ..... H01J 41/16

[52] U.S. Cl. ..... 315/91; 315/88; 315/90

[58] Field of Search ..... 315/65, 88, 90, 91, 315/93, 76

[56] References Cited

U.S. PATENT DOCUMENTS

| | | | |
|---|---|---|---|
| 3,577,173 | 5/1971 | Blomgren | 315/88 |
| 3,678,286 | 7/1972 | Willis | 315/88 X |
| 3,790,846 | 2/1974 | Morris | 315/88 X |
| 4,034,259 | 7/1977 | Schoch | 315/88 X |
| 4,458,179 | 7/1984 | Bainbridge et al. | 315/88 |
| 4,461,974 | 7/1984 | Chiu | 315/88 X |
| 4,712,051 | 12/1987 | Fathi | 315/93 X |
| 4,767,968 | 8/1988 | Geanous et al. | 315/90 |
| 4,785,390 | 11/1988 | Zelina et al. | 315/91 X |

*Primary Examiner*—James J. Groody
*Assistant Examiner*—Mark R. Powell
*Attorney, Agent, or Firm*—Henry C. Nields

[57] ABSTRACT

Equipment for lighting a work area has a plurality of light sources, at least one of which is usually lighted; the others are spare light sources and are usually turned off. The equipment has means such as an optical fiber to conduct light from the light source to the work area. Converting means is provided with the equipment to distribute electric power selectively to the light sources. Detecting means is also installed in the equipment to detect cutting off of the light source which is in the lighted condition. The converting means changes the distribution of the output from the power supply to a light source other than the light source which was cut off.

5 Claims, 2 Drawing Sheets

FIG.1
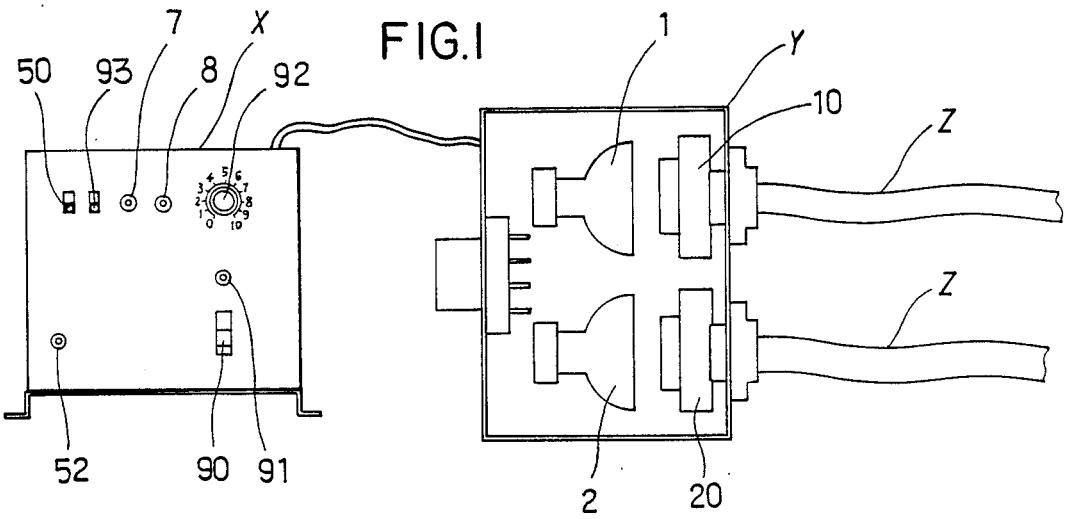
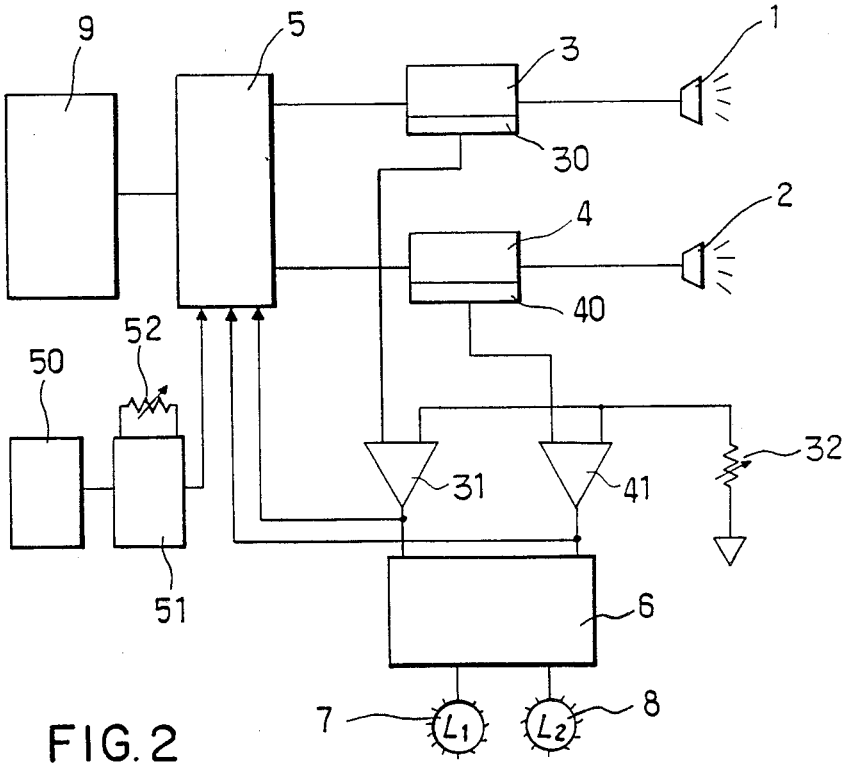
FIG. 2

LIGHTING EQUIPMENT

BACKGROUND OF THE INVENTION

The present invention relates to lighting equipment for industrial automatic machines which do work upon an object and which are controlled by means of information given by a picture of the object obtained by a TV camera or the like. Such lighting equipment is utilized to illuminate the work in such a picture information system.

Illumination is generally required at a moving portion, such as an arm of an industrial robot. Therefore, the light source and other peripheral devices of the equipment are set on a stable portion, and an optical fiber is provided between the light source and the moving portion requiring illumination, so as to conduct light from the source to the moving portion.

With such lighting equipment, accidental turning off of the light source causes many problems. Without illumination, the picture information obtained by the TV camera becomes so incorrect that operation with the automatic machine often must be stopped. Therefore, when the light source fails, it has to be replaced. However, such replacement it is difficult, and it takes a long time to replace the light source if it is mounted on the moving portion of the machine. Furthermore, when no one is aware of the failure of the light source, the operation is performed based on wrong picture information, taken by the TV camera without illumination.

An object of the invention is to provide lighting equipment which can be automatically changed to utilize another light source when a light source fails.

Another object of the invention is to provide lighting equipment which can warn failure of a light source.

A further object of the invention is to provide lighting equipment which can check a light source to ascertain whether it can light or not.

BRIEF DESCRIPTION OF THE DRAWINGS

FIG. 1 is a schematic view showing one embodiment of the invention;

FIG. 2 is a block diagram of the embodiment of FIG. 1;

DETAILED DESCRIPTION OF THE PREFERRED EMBODIMENTS

Figure 3:
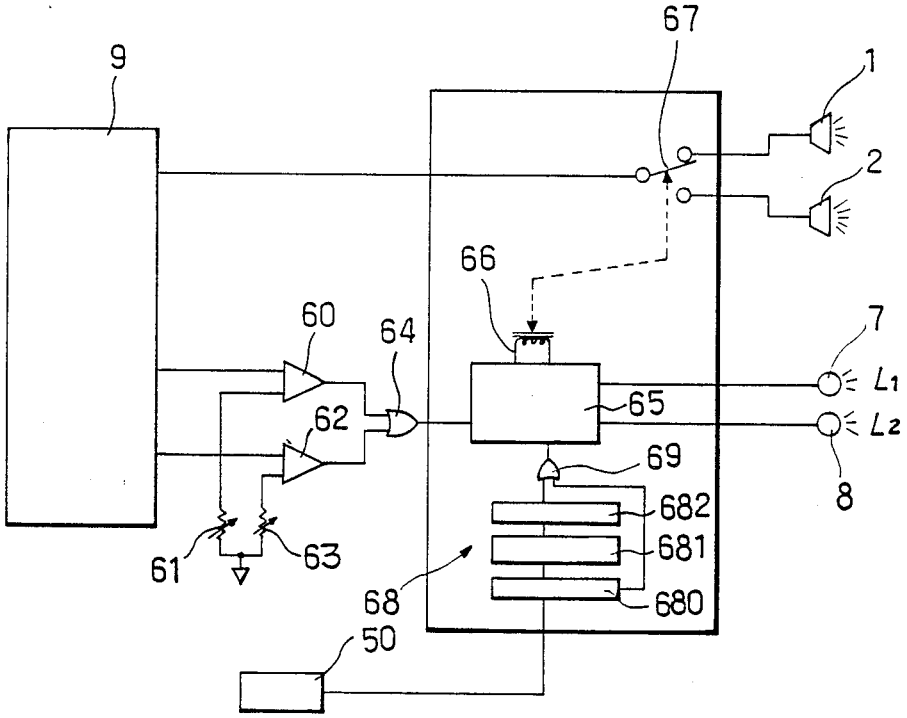
FIG. 3 is a block diagram showing another embodiment of the invention.

The lighting equipment suitable for use with the invention includes a power unit X and a light source unit Y which is connected to the power unit X by a cord as shown in FIG. 1. The position where the power unit X and the light source unit Y are installed depends on the particular application. Usually the power unit X is installed in a control room or the like, and the light source unit Y is set up near a working machine such as a robot which needs the illumination.

The light source until Y includes a pair of light sources 1, 2, one of which is usually lighted, and the other of which is a spare light source which is not usually lighted. In this embodiment lamps are utilized as the light sources 1, 2. The light source 1 is usually lighted and the light source 2 is the spare one. The light sources 1, 2 have respectively filters 10,20 which are connected with optical fibers Z, Z to lead light to the appropriate position.

Referring now to FIG. 2, the power unit X is provided with a power source 9 and a converter 5 described hereinafter, and the power unit X (FIG. 1) has a pair of warning lamps 7, 8 on the front panel thereof. The warning lamp 7 indicates failure of the light source 1, and the warning lamp 8 indicates failure of the light source 2, so that an operator can be aware of the failure of each light source 1, 2 by its respective warning lamp 7, 8. A reset switch 50 is used to check the lighting of a new light source as a replacement after failure of a light source. A timer set volume 52 is used to set a timer 51 described later. As to the reset switch 50, timer 51 and timer set volume 52, detailed explanation will be given later referring to FIG. 2.

The power unit X is further provided with a power source switch 90, a power source indicator 91, and a light intensity control 92 on the front panel. In the embodiment shown an outer control switch 93 is provided so that the light adjustment of light source 1, 2 can be controlled by an external signal.

A detailed explanation will be given referring to FIG. 2. The power source 9 installed within power unit X is connected to the first and second light source circuits 3, 4 via a converter 5. The light source circuits 3, 4 are connected to the light source 1, 2 respectively to light them. The converter 5 distributes the power from the power source 9 selectively to the first light source circuit 3 or to the second light source circuit 4.

The light source circuits 3, 4 respectively include current detectors 30, 40 which detect zero current flows due to the failure of the light source 1, 2. The outputs of the current detectors 30, 40 are input respectively to comparators 31, 41 as voltage to be compared with a standard voltage set by a standard value source 32. The standard value is corresponding to the current flow detected by the current detectors 30, 40 where the light intensity of the light source 1, 2 is lowered by adjusting the light intensity control 92 to the minimum value. The standard value is compared in the comparators 31, 41 with the actual value detected by the current detectors 30, 40. Thus the comparators 31, 41 carry out the distinction between the minimum volume and the failure of the light source 1, 2 so that there is no misjudgment of failure of the light source 1, 2 when the light intensity is merely lowered to the minimum value.

The result of the comparison made by the comparator 31 or comparator 41, i.e. a change in the output voltage level of the comparator 31 or 41, is led to the converter 5 and to a memory 6 for storage stored therein. The memory 6 outputs the stored result to the warming lamp 7 or 8 to turn it on.

The converter 5 delivers the power supplied by the power source 9 to the first light source circuit 3 or to the second light source circuit 4, depending upon the aforementioned result, thereby changing the activated light source from light source 1 to light source 2 or from light source 2 to light source 1.

The reset switch 50 is used for manually changing the power supply from the light source 1 (or the light source 2) to the light source 2 (or the light source 1). It turns off the power supply for a period set by the timer 51. The timer 51 has the timer set control 52 to set up the time necessary for changing a light source. The reset switch 50 is utilized to check lighting of the replaced light source after failure of the former light source.

The operation of the equipment shown in FIG. 1 and 2 will be given below.

The power unit X and the light source unit Y are installed at a predetermined location and they are connected with each other. The optical fiber Z is set at an appropriate position such as the region around the TV camera of a robot. Then the power source switch 90 is switched to turn on the light source 1 or the light source 2; simultaneously the power source indicator 91 is turned on to indicate "power on" to the operator. The light intensity is adjustable by operating the light intensity control 92. When adjusting light intensity is desired to be carried out by a signal from the outside, the outer control switch 93 is switched on. Suppose that the initial stage of the converter 5 is turn on the light source 1, so that the light source 1 is lighted and the light source 2 is off. When the light source 1 happens to fail, the current flow in the first light source circuit 3 become zero, which is detected by the current detector 30. The output of the current detector 30 is compared to the standard value in the comparator 31, which decides that the light source 1 failed, and it is not merely the minimum value. The output of the comparator 31 is transmitted as a signal to the converter 5. The comparator 31 does not judge this signal as meaning a failure unless the output of the current detector 30 is less than the standard value of the standard value source 32. Thus no judgment of failure is provided when the volume of the light source 1 is the minimum (zero).

The signal of failure from the comparator 31 is stored in the memory 6, by which the warning lamp 7 turns on to warn of failure. Simultaneously the converter 5 converts the power output from the power source 9 so as to be delivered to the second light source circuit 4 rather than to the first light source circuit 3, thereby turning on the light source 2.

The operator is alerted to the failure of the light source 1 by the lighting of the warning lamp 7, and so the operator replaces the lamp of the light source 1, and then pushes the reset switch 50. Owing to operation of the switch 50, the converter 5 changes again delivers power to the first light source circuit 3 rather than to the second light source circuit 4. As a result, the light source 1 turns on and the signal of no failure is transmitted to the memory 6 from the comparator 31, so as to turn off the warning lamp 7. Thus the operator can check that the replacement of the light source 1 has been carried out. The deliver of power to the first light source circuit 3 continues within the period determined by the timer 51. After this period has expired, power is converted to the second light source circuit 4, so that the light source 2 is lighted and stays lighted. If the light source 2 fails, the same operation described above is repeated (in reverse): i.e. power from the power supply is converted to the light source 1 and the warning lamp 8 turns on. After replacement of the light source 2 when failed, the replacement is confirmed and the warning lamp 8 is turned off by pushing the reset switch 50.

Another embodiment is shown in FIG. 3.

In this embodiment, failure of the light source is detected in the circuit of the power source 9 and a controller 65 decides which light source failed. Furthermore the current flow of the light circuit in the power source 9 is detected at two portion to make the detection of the failure of the light source more reliable.

Current flow is detected at two points in the power source 9 and a signal voltage is produced at each point which is transmitted to a comparator 60 and a comparator 62 respectively. A standard value source 61 is connected to one input terminal of the comparator 60 and a standard value source 63 is connected to one input terminal of the comparator 62. The voltage corresponding the zero volume of the light source is set up at the standard value source 61 and the standard value source 63 so that the outputs of the comparator 60 and the comparator 62 invert when the voltage from the detecting points of the power source 9 become less than the standard voltage. The outputs are transmitted to the holding relay 66 through an OR circuit 64.

The controller 65 includes a memory circuit which memorizes which light source is currently on. The controller 65 transmits pulse-generating signal to the holding relay 66 after detecting the lamp failure. The holding relay 66 reverses and holds the position of a switch 67 whenever it receives the pulse signal.

A timer 68 in a reset switch 50 includes three timers. A timer 680 and a timer 682 are to generate pulses having predetermined pulse width for generating. Between the timer 680 and the timer 682 there is a timer 681 for counting time to light the lamp (the light source 1 or 2). The outputs of the timer 680 and the timer 682 are input to the controller 65 via an OR circuit 69.

When an activated light source 1 or 2 happens to fail, the failure is detected at the comparator 60 or the comparator 62 and the signal of lamp failure is transmitted to the controller 65. Corresponding to the signal received, the controller 65 sends a pulse-generating signal so as to activate the holding relay 66. The holding relay 66 changes the switch 67 and then holds the state of the switch 67. The controller 65 turns on the warning lamp 7 or 8 corresponding to the light source 1 or 2 stored in the memory thereof to warn of the lamp failure. After replacing the failed light source 1 or 2, the operator pushes the reset switch 50. Then the timer 680 is activated to transmit the pulse with required pulse width (50 ms in the embodiment) to change the holding relay 66. Simultaneously the timer 681 starts to count up and makes the timer 682 turn on after a predetermined period (1 second in the embodiment) later. Then the timer 682 outputs the pulse with desired pulse width to activate the keep relay 66 through the OR circuit 69 and the controller 65 so as to return the switch 67 to the original state. In that way, the replacement of the light source and the check of it are accomplished.

I claim:

1. A lighting equipment having automatic lamp substitution comprising;

a plurality of light sources, means for leading the light from the plurality of light sources to an appropriate portion, switching means for selectively distributing power to at least one of the plurality of light sources in order to activate it, means for adjusting the volume of said power, detecting and comparing means for distinguishing between failure of the activated light source and the minimum volume of the power to the activated light source so as to detect only failure of the activated light source; and said switching means changes the power supply from the failed light source to at least another one of the plurality of light sources responding to a signal from said detecting means.

2. The lighting equipment of claim 1 wherein; p1 said detecting and comparing means detects the failure of the light source by detecting current flow to the light source.

3. The lighting equipment having automatic lamp substitution of claim 1 wherein;

said detecting and comparing means detects the failure of the light source by detecting current flow of the circuit of said power at least at two positions in the circuit of said power.

4. The lighting equipment having automatic lamp substitution of claim 1 further including means for turning on any one of the plurality of light sources for predetermined period to check if the light source is operable.

5. The lighting equipment of claim 1 including means for warning of the failure of the light source.

* * * * *

UNITED STATES PATENT AND TRADEMARK OFFICE

CERTIFICATE OF CORRECTION

PATENT NO. : 4,961,028

DATED : October 2, 1990

INVENTOR(S) : Hiroaki Tanaka

It is certified that error appears in the above-identified patent and that said Letters Patent is hereby corrected as shown below:

Cover page, between items [22] and [51], add

--[30] Foreign Application Priority Data

Dec. 7, 1987 [JP] Japan ..... 62-309182--

Signed and Sealed this

Twenty-eighth Day of April, 1992

*Attest:*

HARRY F. MANBECK, JR.

*Attesting Officer*

*Commissioner of Patents and Trademarks*